US011261822B1

(12) United States Patent
Craft et al.

(10) Patent No.: US 11,261,822 B1
(45) Date of Patent: Mar. 1, 2022

(54) WATER JACKET DIVERTER WITH LOW FLOW RESTRICTION

(71) Applicant: Ford Global Technologies, LLC, Dearborn, MI (US)

(72) Inventors: Justin T. Craft, Royal Oak, MI (US); Phil Cierpial, Grosse Pointe Park, MI (US); Paul Shoemaker, Dearborn, MI (US); Mathew Hintzen, Stockbridge, MI (US); Antony Schepak, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/011,733

(22) Filed: Sep. 3, 2020

(51) Int. Cl.

| | |
|---|---|
| ***F02F 1/16*** | (2006.01) |
| ***F02F 1/14*** | (2006.01) |
| ***F01P 3/02*** | (2006.01) |

(52) U.S. Cl.
CPC *F02F 1/16* (2013.01); *F01P 3/02* (2013.01); *F02F 1/14* (2013.01); *F02F 1/166* (2013.01)

(58) Field of Classification Search
CPC ..... F02F 1/16; F02F 1/166; F02F 1/14; F02F 1/10; F01P 3/02; F01P 2003/021
See application file for complete search history.

(56) References Cited

U.S. PATENT DOCUMENTS

| | | | | |
|---|---|---|---|---|
| 7,051,685 | B2 | 5/2006 | Hayman et al. | |
| 8,839,759 | B2 | 9/2014 | Riegger et al. | |
| 8,919,302 | B2 | 12/2014 | Hamakawa et al. | |
| 8,944,018 | B2 | 2/2015 | Slike et al. | |
| 10,087,894 | B2 | 10/2018 | Beyer et al. | |
| 2005/0235930 | A1* | 10/2005 | Xin | F02F 1/108 123/41.74 |
| 2012/0090565 | A1 | 4/2012 | Beyer et al. | |
| 2012/0312257 | A1 | 12/2012 | Beyer et al. | |
| 2013/0055971 | A1 | 5/2013 | Brewer et al. | |
| 2017/0298860 | A1* | 10/2017 | Mori | F01P 3/02 |
| 2019/0153975 | A1 | 5/2019 | Oh | |

FOREIGN PATENT DOCUMENTS

| | | | |
|---|---|---|---|
| CN | 107667215 | A | 2/2018 |
| JP | 2005188352 | A | 7/2005 |

* cited by examiner

*Primary Examiner* — Jacob M Amick
(74) *Attorney, Agent, or Firm* — Geoffrey Brumbaugh; McCoy Russell LLP

(57) ABSTRACT

Methods and systems are provided for a water jacket diverter. In one example, the water jacket diverter has a continuous upper rail with a profile including curved and linear portions where the profile of the upper rail is optimized to moderate coolant flow through the water jacket. The water jacket diverter further includes at least one protrusion extending outwards from an outer face of the diverter, the at least one protrusion positioned in front of a coolant inlet.

19 Claims, 13 Drawing Sheets

WATER JACKET DIVERTER WITH LOW FLOW RESTRICTION

FIELD

The present description relates generally to a system for cooling an engine block.

BACKGROUND/SUMMARY

Large quantities of heat may be generated during combustion of air and fuel within cylinders of an engine during engine operation. Absorption of the heat may result in a temperature of a cylinder block rising to an extent where cylinder components, such as intake and exhaust valves, pistons, a cylinder bore, etc., may become degraded, particularly upon repeated exposure to the combustion heat. Heat absorption at the cylinders may also increase a likelihood of engine knock and decrease a power output and performance of the engine. As well, engine friction may increase, resulting in reduced fuel economy. The issues associated with excessive heating of the cylinders may be mitigated by providing a system for cooling the cylinder block.

The cylinder block may be cooled by configuring the cylinder block with a water jacket. The water jacket may be one or more cavities in the cylinder block that surround the cylinders and by flowing a coolant through the water jacket, heat may be extracted from the cylinders. However, the cylinder head (coupled to the cylinder block) may not receive a full cooling effect from the coolant due to a positioning of cylinder heads above an upper region of the cylinder block. At least a portion of the cylinder head may extend above a depth of a maximum coolant flow rate in the water jacket. Since engine components, such as intake and exhaust valves, may be located in the cylinder head, it may be desirable to direct coolant flow towards an upper region of the cylinder block to maximize a number of engine components cooled by the coolant.

Attempts to control coolant flow through a water jacket include adapting the water jacket with a spacer configured to be inserted in the water jacket. One example approach is shown by Hamakawa et al. in U.S. Pat. No. 8,919,302. The spacer provided therein includes support legs which partition the water jacket into upper and lower cooling passages and regulate flow of cooling water in the water jacket. An upper rail and a lower rail of the spacer are parallel and each of the rails extend linearly along a periphery of the spacer. A height of the spacer is thus uniform.

However, the inventors herein have recognized potential issues with such systems. As an example, positioning the spacer in the water jacket may create resistance to coolant flow, incurring parasitic losses at a water pump driving coolant flow. Such hydraulic penalties may increase costs and reduce pumping efficiency and may lead to flow imbalances between cylinders.

In one example, the issues described above may be addressed by a diverter for a water jacket having a continuous upper rail arranged around a top periphery of the diverter, above and perpendicular to an inner face and an opposing outer face of the diverter, the upper rail having a profile including both linear portions and portions curving along a cylinder axis of the diverter and at least one protrusion extending away from the outer face of the diverter, the at least one protrusion positioned proximate to a coolant inlet flowing coolant into the water jacket. The geometry of the upper surface of the diverter may control coolant flow through the water jacket to increase a cooling efficiency of the water jacket while reducing hydraulic losses.

As one example, a profile of the upper surface may include curved regions of increased wall height, e.g., peaks, and curved regions of decreased wall height, e.g., valleys, arranged irregularly, e.g., non-uniform and unevenly spaced apart, around a periphery of the diverter. The peaks and valleys may vary in shape, where an arrangement of the peaks and valleys may be optimized to increase coolant flow at target regions of the water jacket. As a result, heat extraction from an upper portion of the cylinder block may be enhanced while reducing friction between coolant and surfaces of the diverter.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-13 are shown approximately to scale.

DETAILED DESCRIPTION

Figure 1:
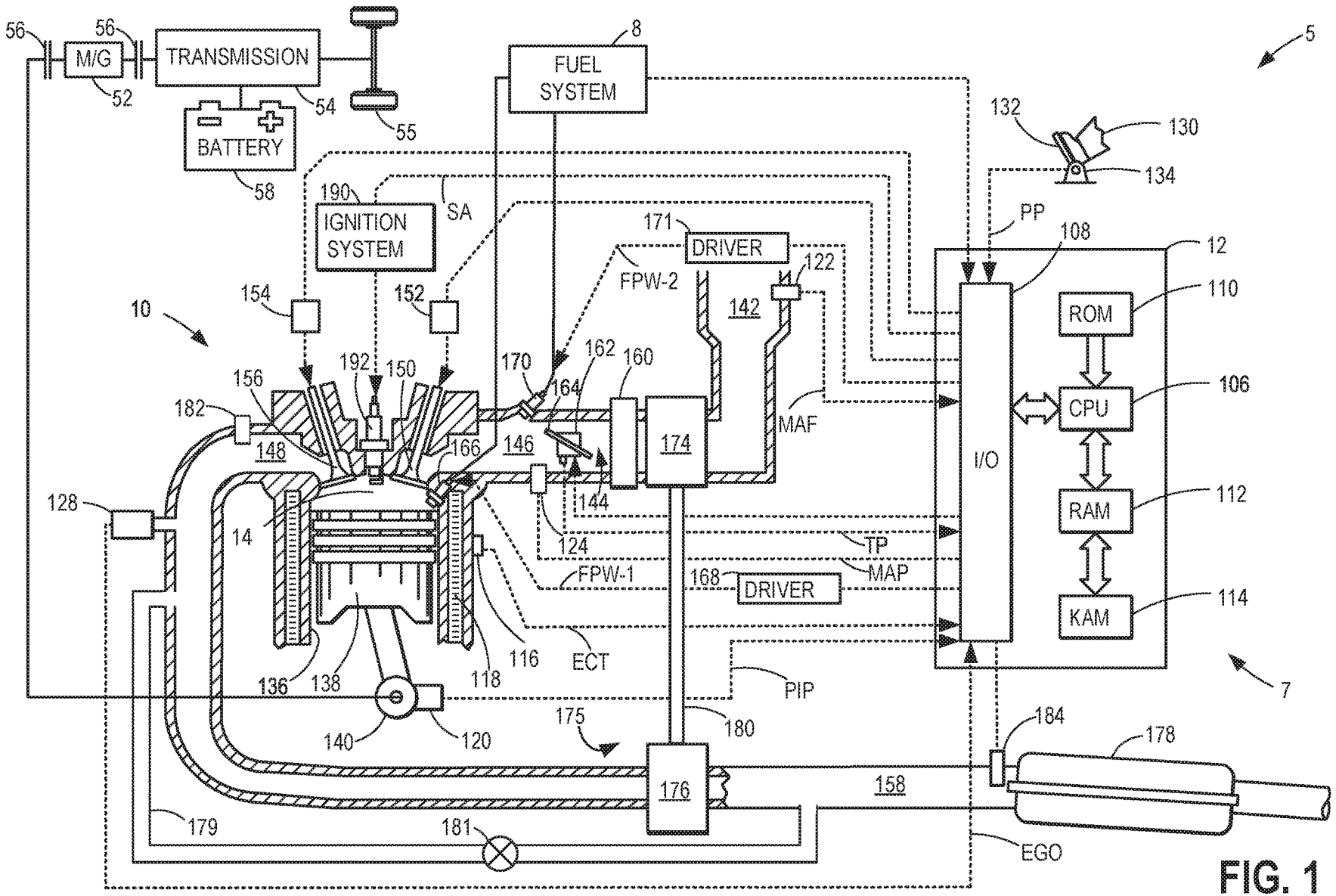
FIG. 1 shows an example engine system that may be adapted with a diverter inserted in water jacket of a cylinder block.
Figure 2:
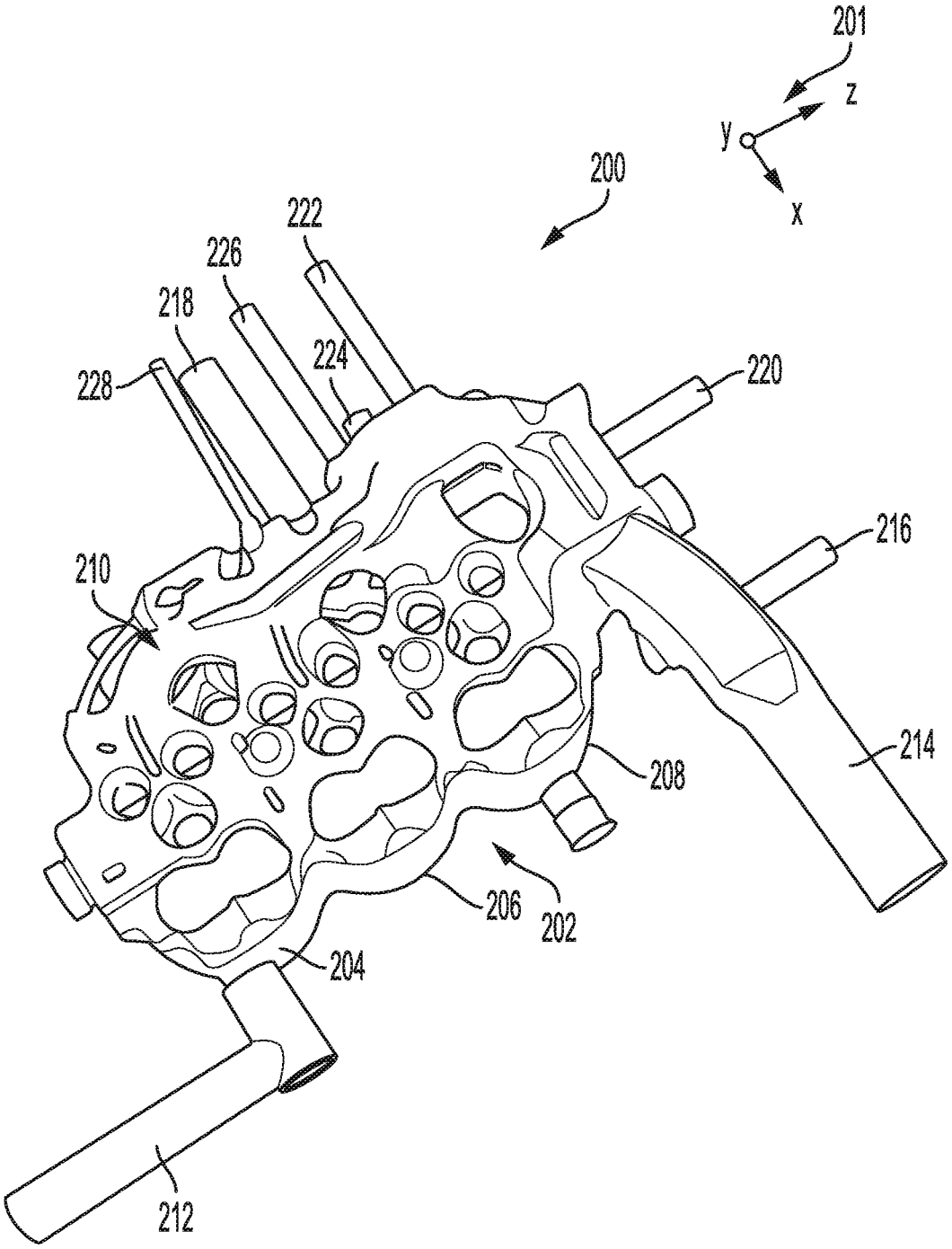
FIG. 2 shows a first example of an engine water jacket which may be adapted with a diverter with a curved top surface.

The following description relates to systems and methods for a water jacket diverter. The diverter may be used in an engine system configured with an engine block formed of a cylinder block and a cylinder head, where a water jacket is disposed in the cylinder block to provide cooling to combustion chambers of the engine block. An exemplary engine system is illustrated in FIG. 1. A diverter may be implemented in a water jacket of an inline, three-cylinder engine, an example of which is shown in FIG. 2, or a water jacket of an inline, four-cylinder engine, an example of which is shown in FIG. 8. However, it will be appreciated that the diverter may be used in a variety of engine types, including V6, V8, etc. A first example of the diverter, adapted with an upper rail profile combining curved and linear portions and configured to be used in the three-cylinder engine of FIG. 2, is depicted in FIGS. 3-7. A second example of the diverter, also having an upper rail with curved and linear portions but configured to be used in the four-cylinder engine of FIG. 8, is shown in FIGS. 9-13.

FIGS. 2-13 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

A vehicle may include an engine system comprising an engine coupled between an intake system and an exhaust system. Vehicle motion may be propelled by combustion of air and fuel at combustion chambers, e.g., cylinders, of the engine. The combustion reaction occurring at the combustion chambers is an exothermic process, resulting in generation of large quantities of heat which may be absorbed by engine components within a proximity of the combusting air/fuel mixture. In particular, a surface, or bore, of a combustion chamber may be particularly susceptible to heat transfer from the combustion process. Thus, heat management at the combustion chambers may be achieved by configuring a casing of the combustion chambers with a cooling device, such as a water jacket.

An example of an engine comprising a water jacket to cool a cylinder is shown in FIG. 1. FIG. 1 depicts an example of a cylinder of internal combustion engine 10 included by engine system 7 of vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (which may be referred to herein as a combustion chamber) of engine 10 may include combustion chamber walls 136 with piston 138 positioned therein. A water jacket 118 may form a cavity within the chamber walls 136 and circumferentially surround cylinder 14. A coolant, such as water or an aqueous solution of ethylene glycol, may be flowed through water jacket 118 to extract heat from the piston 138 and the chamber walls 136. Water jacket 118 may include an insert (not shown), or diverter, such as the embodiments of a diverter shown in FIGS. 3-7 and 9-13 to modify a path of coolant flow through the water jacket 118.

Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 may receive intake air via a series of intake air passages 142, 144, and 146. Intake air passage 146 may communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along the exhaust system between an exhaust manifold 148 and an exhaust pipe 158. Compressor 174 may be mechanically coupled to turbine 176 by a shaft 180. A speed of compressor 174 may be regulated by a wastegate 181, arranged in an exhaust system of the engine system 7. In some examples, turbocharger 175 may be an electric turbocharger and at least partially powered by an electric motor.

A charge air cooler (CAC) 160 may be positioned in intake passage 142 downstream of compressor 174 and upstream of a throttle 162. The CAC 160 may be an air-to-air CAC or a liquid-cooled CAC, configured to cool and increase a density of air compressed by the compressor 174. The cooled air may be delivered to the engine 10 and combusted at cylinder 14.

Throttle 162, including a throttle plate 164, may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 may have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Operation of intake valve 150 is now described in greater detail. The intake valve 150 may be moved from a fully open position to a fully closed position, or to any position there-between. Assuming all other conditions and parameters are constant (e.g., for a given throttle position, vehicle speed, manifold pressure, etc.), the fully open position of the valve allows more air from the intake passage 146 to enter the cylinder 14 than any other position of the intake valve 150. Conversely, the fully closed position may prevent air flow (or allow the least amount of air) from the intake passage 146 into the cylinder 14 relative to any other position of the intake valve 150. Thus, the positions between the fully open and fully closed position may allow varying amounts of air to flow between the intake passage 146 to the cylinder 14. In one example, moving the intake valve 150 to a more open position allows more air to flow from the intake passage 146 to the cylinder 14 than its initial position.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

As the mixture of intake air and fuel is combusted at cylinder 14, exhaust valve 156 may be commanded to open and flow exhaust gas from cylinder 14 to exhaust manifold 148. The opening of the exhaust valve 156 may be timed to open before intake valve 150 is fully closed so that there is a period of overlap when both valves are at least partially open. The overlap may generate a weak vacuum that accelerates the air-fuel mixture into the cylinder, e.g., exhaust scavenging. The period of valve overlap may be timed in response to engine speed, camshaft valve timing, and configuration of the exhaust system. Exhaust manifold 148 can receive exhaust gases from other cylinders of engine 10 in addition to cylinder 14. The exhaust gas channeled from cylinder 14 to exhaust manifold 148 may flow to turbine 176 or bypass turbine 176 via bypass passage 179 and wastegate 181.

Exhaust gas that is directed to turbine 176 may drive the rotation of turbine 176 when wastegate 181 is closed, thereby spinning compressor 174. Alternatively, when wastegate 181 is at least partially open, e.g., adjusted to a position between fully closed and fully open, or fully open, a portion of the exhaust gas may be diverted around turbine 176 through bypass passage 179. Shunting exhaust flow through bypass passage 179 may decrease the rotation of turbine 176, thereby reducing the amount of boost provided to intake air in intake passage 142 by compressor 174. Thus during events where a rapid decrease in boost is desired, e.g., a tip-out at input device 132, turbine 176 may be decelerated by opening wastegate 181 and reducing the amount of exhaust gas directed to turbine 176.

Wastegate 181 is disposed in bypass passage 179 which couples exhaust manifold 148, downstream exhaust gas sensor 128, to an exhaust pipe 158, between turbine 176 and emission control device 178. Spent exhaust gas from turbine 176 and exhaust gas routed through bypass passage 179 may convene in exhaust pipe 158 upstream of emission control device 178 before catalytic treatment at emission control device 178.

Exhaust gas sensor 128 is shown coupled to exhaust manifold 148 upstream of turbine 176 and a junction between bypass passage 179 and exhaust manifold 148. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example, before treatment at emission control device 178. Emission control device 178 may be a three-way catalyst (TWC), NOx trap, various other emission control devices, or combinations thereof, configured to remove undesirable chemicals from the exhaust gas prior to atmospheric release.

The valves described above and other actuatable components of vehicle 5 may be controlled by controller 12. Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from the various sensors coupled to engine 10 depicted at FIG. 1. In addition to those signals previously discussed, the controller may receive signals including measurement of inducted mass air flow (MAF) from mass air flow sensor 122; engine coolant temperature (ECT) from temperature sensor 116 coupled to water jacket 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Exhaust manifold pressure may be measured by a pressure sensor 182 and pressure in the exhaust pipe 158 measured by another pressure sensor 184. Controller 12 may infer an engine temperature based on an engine coolant temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from an energy storage device 58 (herein, battery 58) to provide torque to vehicle wheels 55. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, the controller may use a temperature measured by the temperature sensor 116 at water jacket 118 to adjust a flow rate of coolant through the water jacket. If the temperature is detected to increase above a threshold temperature, the controller 12 may command a water pump to increase a pumping speed to pump coolant through the water jacket at a faster rate, thereby increasing heat extraction by the coolant. As another example, the temperature measured at the water jacket 118 by the temperature sensor 116 may be used to infer a temperature in the cylinder 14. Spark timing may be advanced based on the estimated cylinder temperature to achieve increased power output during vehicle operations demanding increased torque delivery.

Thermal management at a cylinder block may reduce a temperature of the cylinder block during combustion events, allowing more power to be derived from the engine through spark advancement. A fuel economy of the engine may be improved due to decreased friction between engine components when efficient cooling of the cylinder block is implemented. While cooling of the cylinder block may be achieved by flowing a coolant through a water jacket, such as the water jacket 118 of FIG. 1, of the cylinder block, coolant flow rate tends to be greatest proximate to a lower portion of the cylinder block. As a result, heat is extracted more rapidly from the lower portion of the cylinder block than an upper portion. However, generation of heat via combustion may occur primarily within the upper portion of the cylinder, where the cylinder block is coupled to a cylinder head (the cylinder head including the intake and exhaust valves) resulting in a temperature gradient of the cylinder block that increases upwards. Slower coolant flow through an upper portion of the water jacket may inefficiently cool the upper portion of the cylinder block, where greater cooling capacity is desired.

To address this issue, a spacer or diverter may be arranged in the water jacket, the diverter configured to peripherally surround the cylinders of the cylinder block. The diverter may be positioned in a lower portion of the water jacket, relative to a vertical direction, thus forcing coolant flow to be greater in an upper portion of the water jacket, above the diverter. For example, the diverter may moderate a coolant flow field such that flow is predominant in an upper third of an inner bore of the water jacket where the inner bore is a surface of the water jacket closest to the cylinder. Cooling efficiency is thereby increased in a region of the cylinder block experiencing elevated temperatures which may otherwise lead to thermal deformation of cylinder components. However, inserting the diverter in the path of coolant flow within the water jacket may result in increased hydraulic penalties associated with parasitic losses at a water pump driving coolant flow.

In order to reduce hydraulic losses, a top surface or upper rail of the diverter may be modified to minimize friction between the coolant and the diverter surfaces. For example, a profile of the top surface of the diverter, as well as a width of the diverter, may be adjusted based on a size of the water jacket and an arrangement of flow metering holes of the cylinder block. The top surface of the diverter may meander along the vertical direction, forming curved (e.g., convex and concave) and linear portions, which varies a height of the diverter, and may result in lower hydraulic losses relative to a diverter with a flat top surface and uniform height. Furthermore, the top surface may enhance consistency of coolant flow between cylinders, thereby increasing cylinder-to-cylinder balance while effectively directing coolant flow to the upper portion of the water jacket. Examples of diverters with a non-uniform height and a top surface with a profile including curved and linear portions are described further below with reference to FIGS. 3-7 and 9-13 and exemplary engines in which the diverters may be implemented are depicted in FIGS. 2 and 8.

Turning now to FIG. 2, a water jacket 200 of an inline 3-cylinder engine is illustrated. In other words, only fluid passages of the engine are shown in FIG. 2, through which coolant may flow. As such, references to engine components, such as cylinders and passages, are representative of coolant reservoirs and channels around the named components as formed in a material of the engine. In one example, the water jacket 200 may be a non-limiting example of the water jacket 118 of FIG. 1. A set of reference axes 201 are provided for comparison between views, indicating an x-axis, a y-axis, and a z-axis. In one example, the y-axis may be parallel with a cylinder axis of the water jacket 200 (as well as of a water jacket 800 shown in FIG. 8). The water jacket 200 includes cylinder block 202 with a first cylinder 204, a second cylinder 206, and a third cylinder 208 and a cylinder head 210 arranged above the cylinder block 202 with respect to the y-axis.

Coolant may flow into the water jacket 200 at the cylinder block 202 via a first, or main inlet 212 coupled to the cylinder block 202 at a lower portion of the cylinder block 202, with respect to the y-axis, and exit the water jacket 200 through a first, or main outlet 214 coupled to the cylinder head 210, where the water jacket 200 extends into the cylinder head 210. The water jacket 200 may include additional coolant channels such as a second inlet 216 directing flow of coolant from an EGR cooler, a third inlet 218 flowing coolant from a turbocharger, a fourth inlet 226 flowing coolant from an EGR valve, a second outlet 220 flowing coolant to the EGR cooler, a third outlet 222 flowing coolant to an EGR valve, a fourth outlet 224 flowing coolant to the turbocharger, and a fifth outlet 228 which may be a degas passage. The coolant may also flow through various gasket openings or flow metering holes of the engine.

In this way, a temperature of the coolant may be lowest when the coolant first enters the water jacket 200 via the main inlet 212 at the lower portion of the cylinder block 202 and increases as the coolant flows around the first, second and third cylinders 204, 206, 208 and up into the cylinder head 210. Thus a cooling capacity of the coolant may be reduced at a cylinder positioned at an end of a cylinder bank distal to the main inlet 212 compared to a cylinder positioned directly in front of the main inlet 212. The distal cylinder may be more prone to degradation. However, regulating coolant flow so that coolant remains at a low temperature as it flows around the cylinders at an upper portion of the cylinder block 202, may reduce a likelihood of thermal deformation of components such as pistons, gaskets, etc. This may be achieved by constraining coolant flow to the upper portion of the cylinder block 202 which may be facilitated by inserting a diverter into the water jacket. The diverter may be shaped to match a shape of the water jacket along a plane perpendicular to a cylinder axis and have a suitable thinness to allow the diverter to fit between an inner bore and an outer bore (e.g., an inner wall closer to the cylinders and an outer wall farther from the cylinders) of the water jacket while allowing a desired amount of coolant to flow between surfaces of the diverter and the inner and outer bores of the water jacket. The diverter may sit at a bottom of the water jacket and occupy a portion of a volume of the water jacket, thus displacing coolant from the lower portion of the water jacket.

Figure 3:
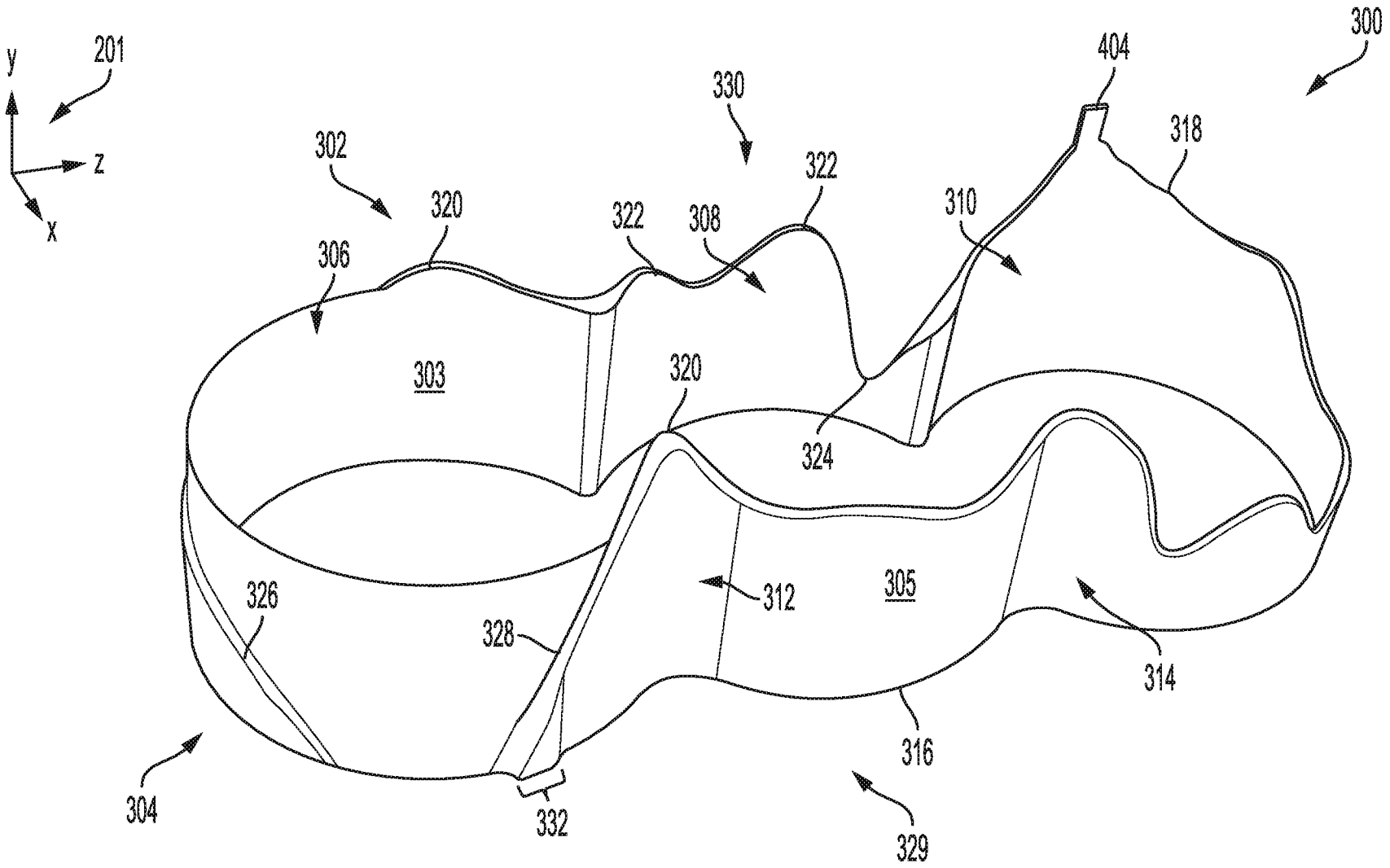
FIG. 3 shows a first example of a diverter with a curved top surface from a perspective view.
Figure 4:
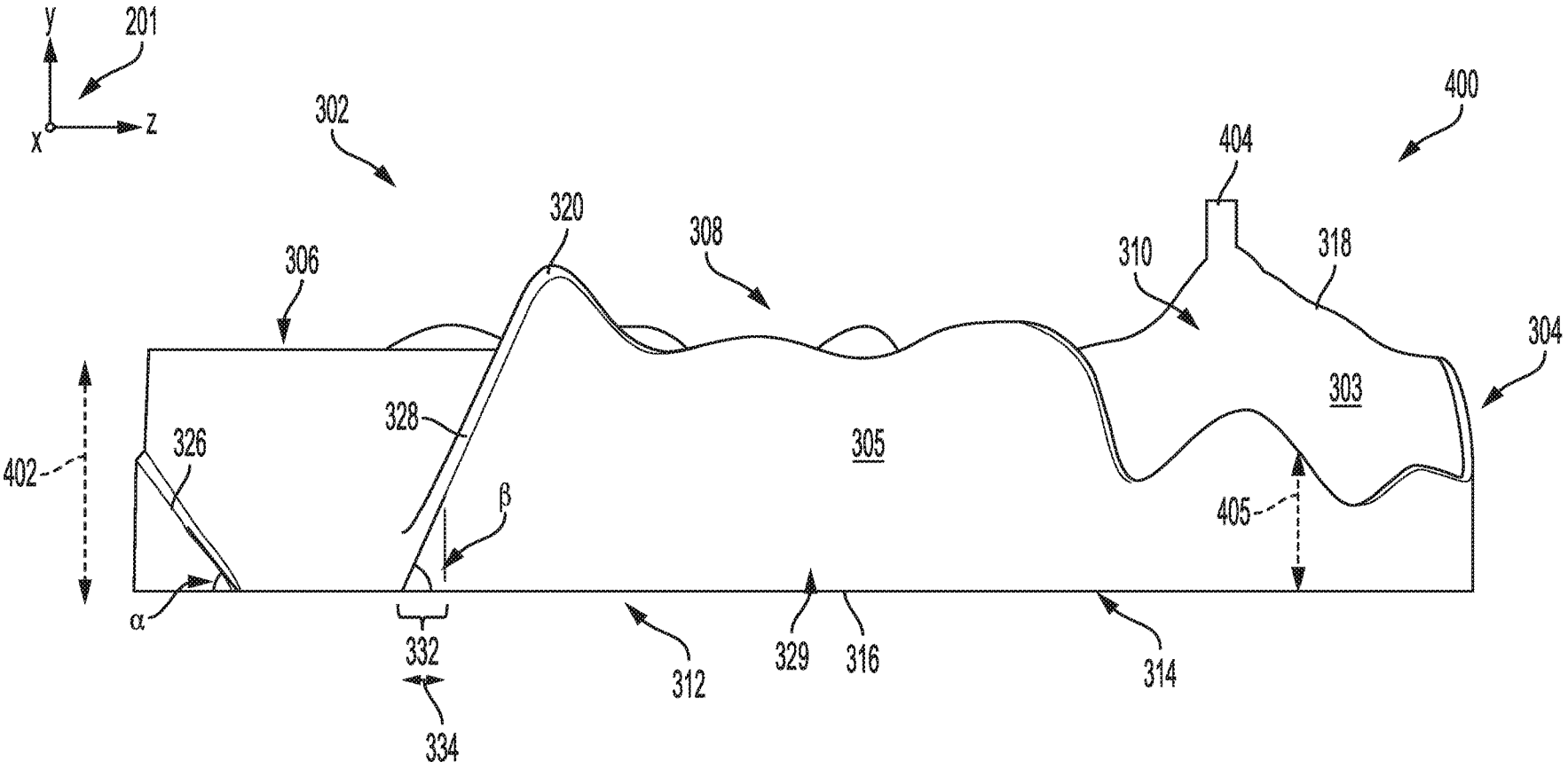
FIG. 4 shows a first side view of the diverter of FIG. 3.
Figure 5:
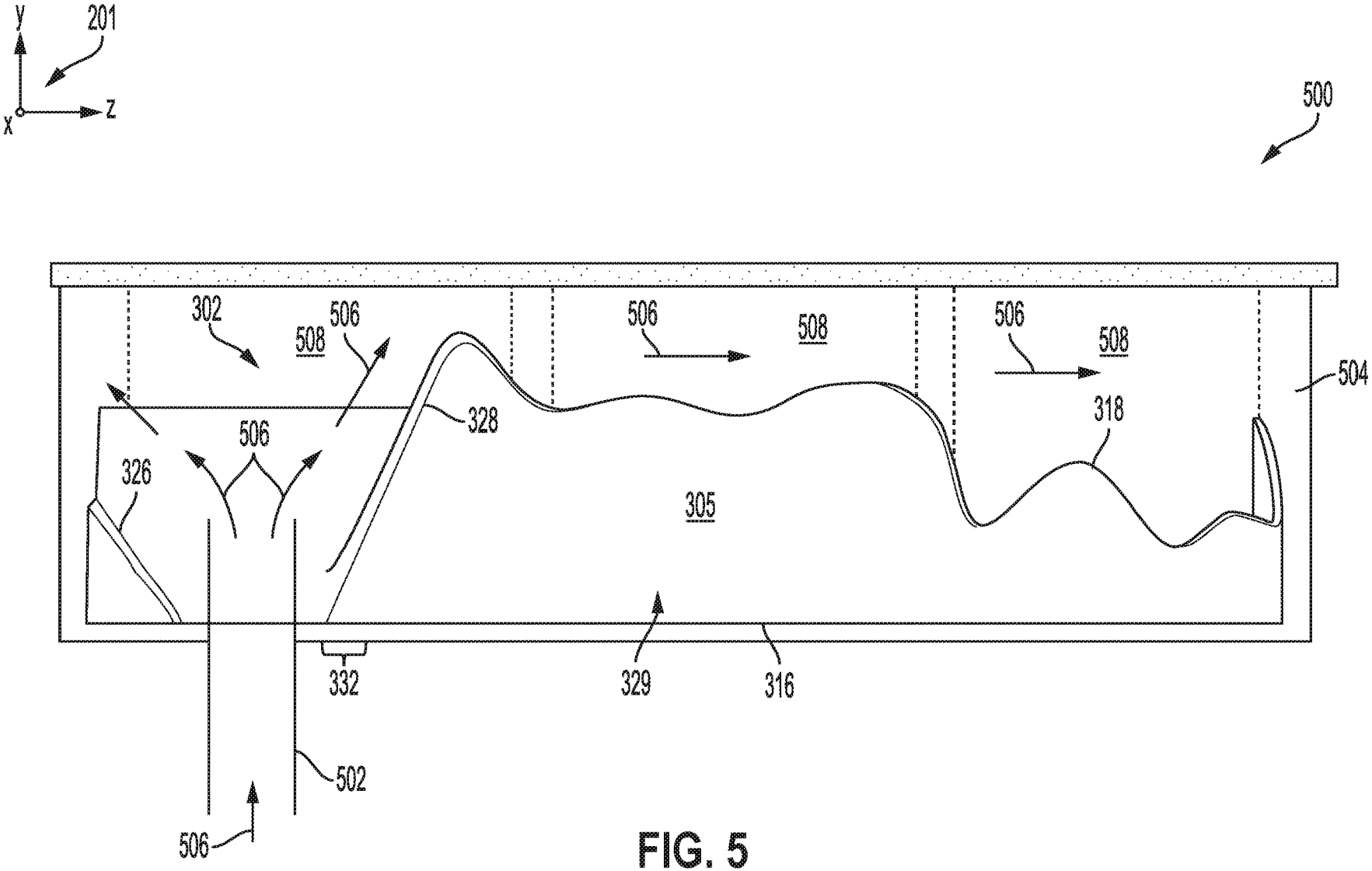
FIG. 5 shows the diverter of FIG. 3 inserted in a water jacket of a cylinder block.
Figure 6:
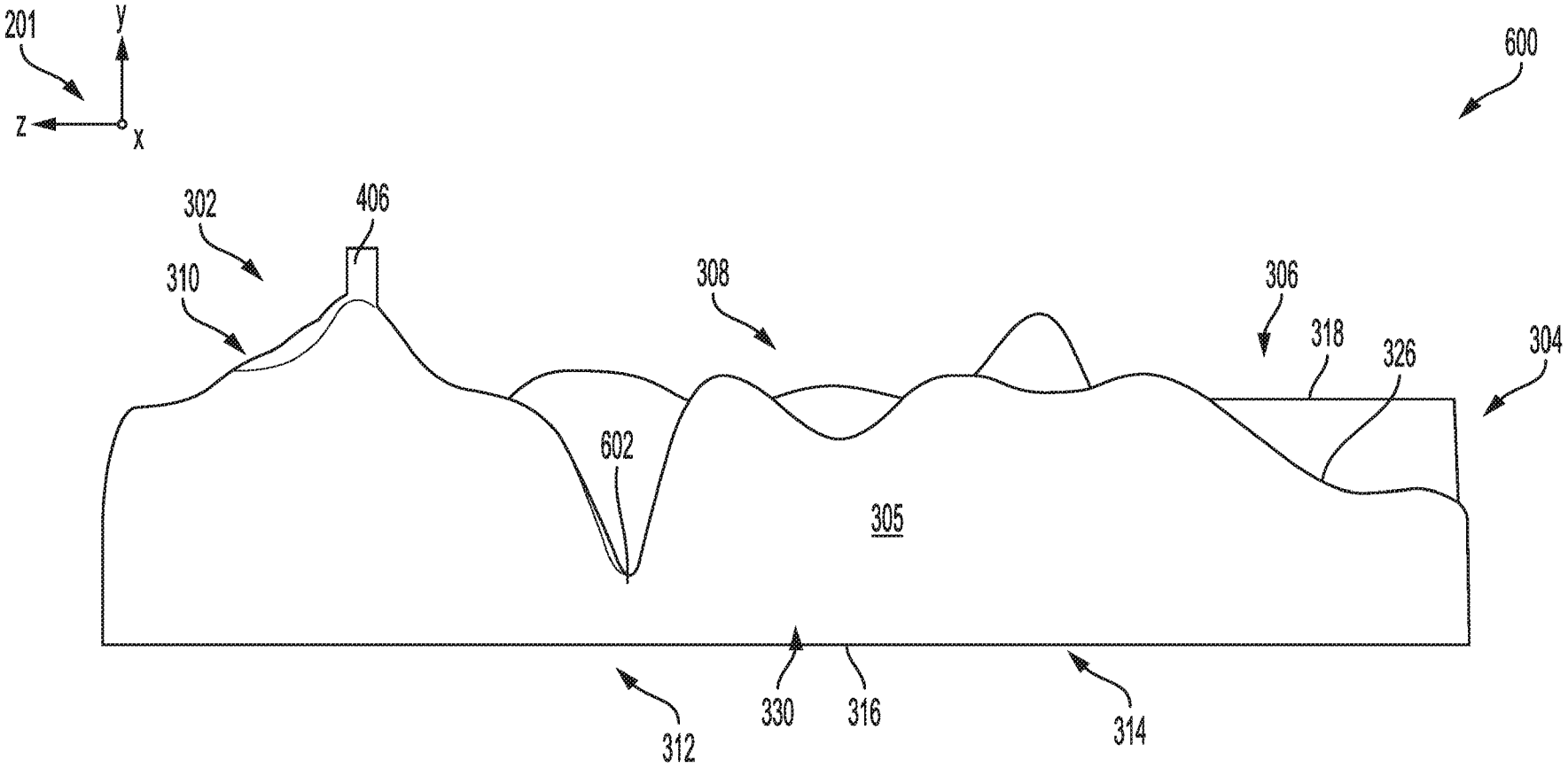
FIG. 6 shows a second side view of the diverter of FIG. 3.
Figure 7:
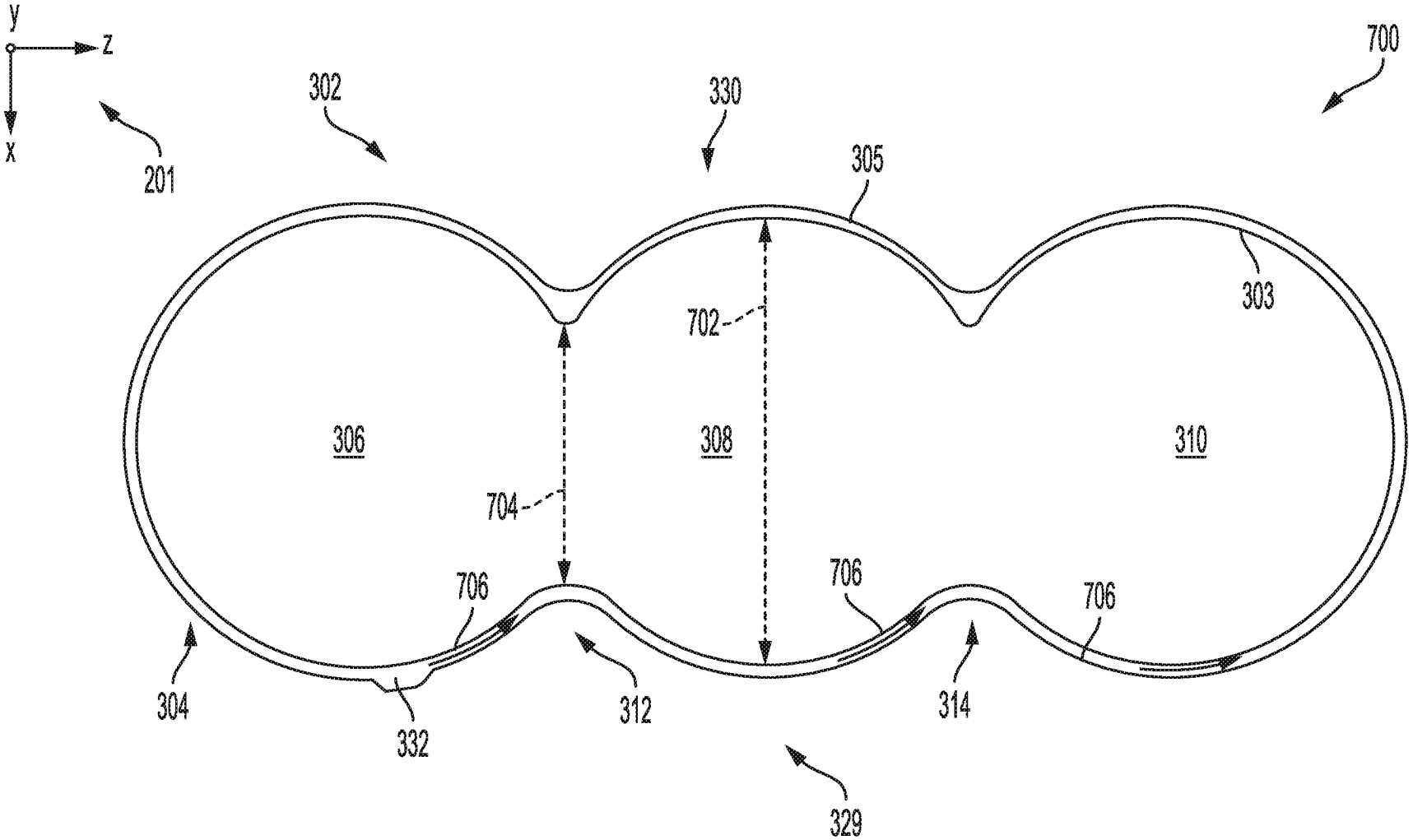
FIG. 7 shows a top-down view of the diverter of FIG. 3.
Figure 8:
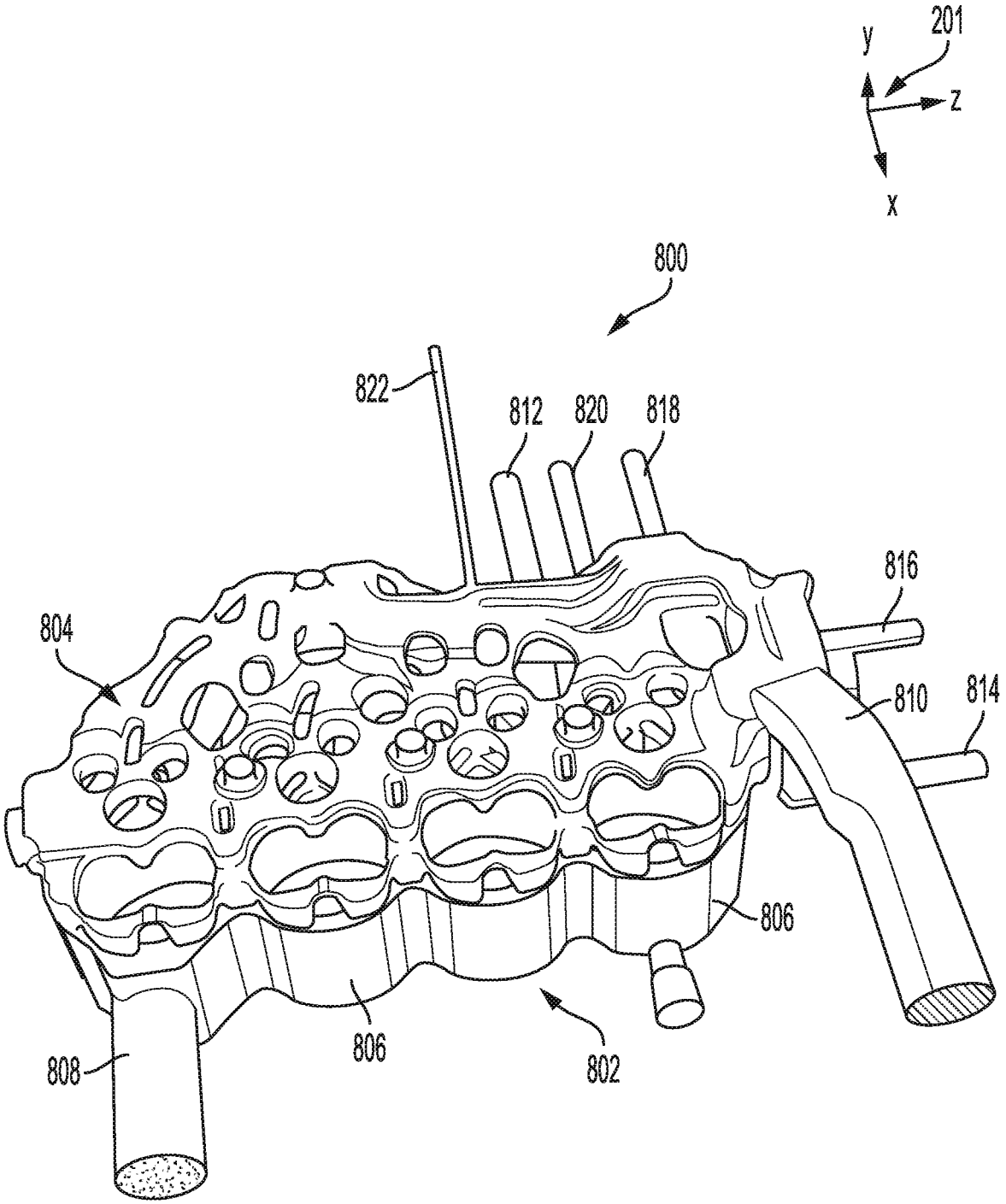
FIG. 8 shows a second example of an engine water jacket which may adapted with a diverter with a curved top surface.

A first example of a diverter 302 is shown from a perspective view 300 in FIG. 3, from a first side view 400 in FIG. 4, positioned in a cylinder block 500 in FIG. 5, from a second side view 600 in FIG. 6, and a top-down view 700 in FIG. 7. The diverter 302 has a curving, continuous wall 304 where the wall is shaped to surround three cylinders in a cylinder block. The wall 304 has a smooth inner face 303 and an outer face 305 which may include one or more regions where the outer face 305 protrudes outwards and away from the inner face 303, as described further below. The diverter 302 may be configured to surround cylinders of an inline, three-cylinder engine within a water jacket, such as the water jacket 200 of FIG. 2, and includes a first circular section 306, a second circular section 308, and a third circular section 310, the circular sections aligned along the z-axis.

A diameter 702, as shown in FIG. 7, of each of the circular sections of the diverter 302 may be similar while a width 704 of the diverter 302 in regions between the circular sections may be smaller than the diameter 702 of the circular sections. In other words, the diverter 302 may have a first pinched region 312 between the first circular section 306 and the second circular section 308 and a second pinched region 314 between the second circular section 308 and the third circular section 310. The pinched regions may correspond to areas between cylinders of the cylinder block. The first circular section 306 may be proximate to a main coolant inlet of the cylinder block, e.g., the main inlet 212 of FIG. 2, and the third circular section 310 may be proximate to a main coolant outlet of the cylinder block, e.g., the main outlet 214 of FIG. 2.

The diverter 302 has a continuous lower rail or bottom surface 316 that is parallel with the z-axis around an entire perimeter of the diverter 302. A continuous upper rail or top surface 318 of the diverter, however, is not parallel with the z-axis and meanders in a variable manner along the y-axis forming a curving profile with various valleys, e.g., convex regions of decreased height, and peaks, e.g., concave regions of increased height around a periphery of the diverter 302. The curving profile of the top surface 318 may include both curved and linear portions. A height 402 of the diverter 302 may vary around the diverter 302 in a non-uniform manner, having a highest point 404, as shown in FIGS. 4 and 6, in the third circular section 310 and a lowest point 602 in the second circular section 308, as shown in FIG. 6. The highest point 404 may also be a tab 404 and will be described further below. Furthermore, the valleys and peaks may not be symmetric about a lowest point of each valley and a highest point of each peak.

An amount of valleys and/or peaks may vary amongst the circular sections of the diverter 302. For example, as shown in FIG. 3, the top surface 318 of the diverter 302 along the first circular section 306 may be mostly flat, e.g., linear and parallel with the x-y plane, but include two peaks 320 on opposite sides of the first circular section 306 proximate to the first pinched region 312, the two peaks 320 differing in height and shape. As such, the top surface 318 of the diverter is flat and perpendicular to the cylinder axis between the two peaks 320. The second circular section 308 may have two peaks 322 of varying heights and shapes and one valley 324 along a same side of the second circular section 308. The third circular section 310 may exhibit a greater amount of variation in height 402 of the wall 304 than the first or second circular sections 306, 308, and include the tab 404, as shown in FIGS. 4 and 6.

It will be appreciated that the diverter 302 of FIGS. 3-7 is a non-limiting example. Other examples may include variations in a geometry of the top surface such that each circular section of the diverter may include different quantities of peaks and valleys and a height of the diverter may vary in a different manner. In yet other examples, the bottom surface may not be flat and parallel with the x-z plane around an entire perimeter of the diverter. The geometry of diverter may be modified according to a size of the water jacket and positioning of flow metering holes of the engine without departing from the scope of the present disclosure.

The outer face 305 of the wall 304 of the diverter 302 may be configured with sloping surfaces or ramps. More specifically, the outer face 305 along the first circular section 306 of the diverter 302 may include a first ramp 326 and a second ramp 328, as shown in FIGS. 3-5, the first and second ramps 326, 328 spaced apart from one another in opposite directions. The ramps may protrude outwards, away from the inner face 303 of the wall 304 and a thickness of the wall 304, where the thickness is a distance between the inner face 303 and the outer face 305, may be greater below the ramps than above the ramps, with respect to the y-axis.

The first ramp 326 may slope upwards from the bottom surface 316 of the diverter 302 at a first or front side 329 of the diverter 302, as shown in FIG. 3 along a clockwise direction when viewing the diverter 302 from above, e.g., as shown in FIG. 7. The front side 329 may be a side of the diverter 302 closest to a main coolant inlet 502, as shown in FIG. 5, and opposite from a second or rear side 330 of the diverter 302. The first ramp 326 may initially extend linearly around the front side 329 of the first circular section 306 at an angle $\alpha$ (as shown in FIG. 4) less than 90 degrees relative to the bottom surface 316. In one example, $\alpha$ may be 45 degrees but in other examples, a may be any angle between 5 and 85 degrees. A value of a, as well of an angle $\beta$ of the second ramp 328, may be customized according to a positioning of the main coolant inlet 502 relative to the diverter 302 and may thus vary with a specific geometry of the inlet. For example, how the inlet bends prior to coupling to the water jacket, where along the height of the diverter 302 the inlet couples to the water jacket, etc., may affect an angle of each of the first and second ramps 326, 328.

The first ramp 326 continues around the first circular section 306 to the rear side 330 of the diverter 302, as shown in FIG. 6. Along the rear side 330, the first ramp 326 may curve and forming both convex and concave regions, e.g., become non-linear, while gradually sloping upwards to the top surface 318 of the diverter 302. The first ramp 326, in one example, may merge with or transition into the top surface 318 and become the top surface 318 of the diverter 302.

The second ramp 328 may also slope upwards from the bottom surface 316 of the diverter 302 at the front side 329 along a counter-clockwise when viewed from above, e.g., as shown in FIG. 7. Similar to the first ramp 326, the second ramp 328 may initially extend linearly along the front side 329 of the first circular section 306 at the angle $\beta$ (as shown in FIG. 4) less than 90 degrees relative to the bottom surface 316. In one example, $\beta$ may be 45 degrees but in other examples, $\beta$ may be any angle between 5 and 85 degrees and may vary depending on the geometry and positioning of the main coolant inlet 502, as described above. The second ramp 328 may continue along the front side 329 of the diverter 302 to merge with the top surface 318 to form one of the peaks 320 along the top surface 318 of the first circular section 306. Thereon, the second ramp 328, similar to the first ramp 326, may become the top surface 318 and be continuous with the first ramp 326.

An initial section of the second ramp 328, e.g., where the second ramp 328 slopes upwards and away from the bottom surface 316 of the diverter 302, may include a protrusion or ledge 332 where the thickness of the wall 304 of the diverter 302 is increased. The increase in wall thickness may extend from the bottom surface 316 to the second ramp 328 for a distance 334 along the z-axis across the outer face 305 of the diverter 302 and taper to a decreased wall thickness. The thickness of the wall 304 may increase by, for example, 50% at the ledge 332. In other examples, the increase in wall thickness may be between 25-100%. A change in wall thickness at the ledge 332 may be determined based on a desire to control a native pressure differential of the coolant flow field within the water jacket and bias the flow field towards target regions that may otherwise be unfavorable for high flow rates. As the ledge 332 is positioned near the bottom surface 316 of the diverter 302, e.g., positioned low relative to the height of the diverter, the thickness of the ledge 332 may effectively reduce flow around a lower portion of the diverter and hence through the lower portion of the water jacket. Flow is instead diverted towards the upper portion of the water jacket and to the cylinder head.

The first and second ramps 326, 328 may be positioned such that a flow of coolant from the main coolant inlet 502, as shown in FIG. 5, enters a water jacket 504 of the cylinder block 500 at a region between the first and second ramps 326, 328. In one example, the water jacket 504 may be the water jacket 200 of FIG. 2. As the coolant enters, flow is diverted upwards by the ramps, as indicated by arrows 506, to a portion of the water jacket above the diverter 302. The upwards flow is further motivated by the presence of the ledge 332. The increase in wall thickness at the ledge 332 may block coolant flow between the outer face 305 of the diverter 302 and an inner surface of the water jacket 504 at the ledge 332. Coolant is instead forced to flow above the ledge 332, guided by the second ramp 328. Thus, by inserting the diverter 302 into the water jacket 504, a coolant flow field within the water jacket 504 is altered to increase coolant flow at the upper portion of the water jacket, thereby increasing cooling efficiency at upper portions of a plurality of cylinders 508 of the cylinder block 500.

A position of the diverter 302 at the lower portion of the water jacket 504 may be maintained by the tab 404. For example, the tab 404 may extend to a top inner surface of the water jacket, inhibiting upwards displacement of the diverter 302 resulting from, for example, a buoyancy of the diverter 302. The tab 404 thereby forces the diverter 302 to remain in the bottom portion of the water jacket and may be positioned in a low pressure area to minimize its effect on the coolant flow field. It will be appreciated that other examples may include additional tabs extending up from the top surface 318 of the diverter 302, also positioned in areas corresponding to low pressure regions in the water jacket.

The combination of curved and linear portions of the top surface 318 of the diverter 302 may moderate coolant flow such that flow is similar around each of the plurality of cylinders 508. By controlling coolant flow around the plurality of cylinders 508 via the geometry of the top surface 318 of the diverter 302, each cylinder is similarly cooled and cylinder-cylinder balance may be equalized. A pressure gradient across the water jacket 504 is minimized and areas of stagnant coolant are reduced. For example, as depicted in FIG. 4, an average height 405 of the wall 304 along the front side 329 of the third circular section 310 of the diverter 302 may be shorter than average heights of the front side 329 of each of the first and second circular sections 306, 308. The rear side 330 of the third circular section 310 includes the tab 404 of the wall 304. Thus, the height of the wall 304 in the third circular section 310 varies to a greater extent than in the first or second circular sections 306, 308.

The greater change in wall height at the third circular section 310 may assist in drawing coolant flow from the main coolant inlet 502 and up the second ramp 326 to the portion of the water jacket 504, as shown in FIG. 5 and indicated by arrows 506. The coolant may flow above the front side 329 of the diverter 302 in a counter-clockwise direction when viewed from above, as indicated by arrows 706 in FIG. 7. The flow may be driven by the larger water jacket volume in the portion above the front side 329 of the third circular section 310 resulting from the lower wall height as compared to the water jacket volume in the portions above the front side 329 of the first circular section 306 and above the front side 329 of the second circular section 308.

The increased height of the wall at the rear side 330 of the third circular section 310 may slow coolant flow in the upper portion of the water jacket 504 from the third circular section 310 to the first circular section 306 above the rear side 330 of the diverter 302 (e.g., along the counter-clockwise direction when viewed from above). By reducing flow away from the third circular section 310, coolant flow upwards in the water jacket 504 above the third circular section 310 of the diverter 302 and out through a main coolant outlet, such as the main outlet 214 of FIG. 2, is increased. Increasing the coolant flow out of the water jacket enhances a cooling efficiency of the water jacket 504 by replacing the coolant with fresh (e.g., colder) coolant at a faster rate. In other words, within a convection dominated zone, flow velocity may be directly correlated to a rate of heat transfer. Thus, increasing local surface velocities within an area may increase the heat transfer rate due to a greater heat flux present at the upper portion of the cylinder block. As such, a desired heat transfer configured to provide cooling to target areas of the cylinder block may be biased to flow to heat input locations, e.g., to the upper portion of the cylinder block.

Furthermore, the geometry of the diverter 302 increases coolant flow at the upper portion of the water jacket above the third circular section 310 which may be a region of the water jacket distal to the main coolant inlet 502 where the coolant temperature is lowest. As the coolant flows towards the third circular section 310 of the diverter 302 in the water jacket, the coolant absorbs heat from the cylinders, resulting in higher coolant temperatures when the coolant reaches the water jacket above the third circular section 310. The warming of coolant may be offset by the greater flow above the third circular section 310 of the diverter 302, thereby enabling coolant temperature to be similar at each cylinder of the cylinder block. Increasing flow to the portion of the water jacket above the third circular section 310 of the diverter 302 may also equalize pressure across the water jacket. As a result, less work is performed by a water pump driving coolant flow to equalize cylinder-cylinder balance and parasitic losses are reduced. In other words, the diverter 302 may be configured to simultaneously provide cylinder-cylinder balance and match heat flux into the water jacket. Implementation of the diverter 302 in the water jacket may lead to reduced deformation patterns, thus providing a fuel efficiency benefit, due to reduced engine friction, and a thermal efficiency benefit, which may enable downsizing of an engine cooling system. For example, a pump size may be decreased.

As described above, the diverter shown in FIGS. 3-7 is a non-limiting example and may be adapted to an inline, three-cylinder engine. Other examples may include diverters suitable for different engine types. For example, a diverter may be implemented in a water jacket 800 of an inline, four-cylinder engine, as shown in FIG. 8. As described above, with reference to FIG. 2, references to engine components, such as cylinders and passages, are representative of coolant reservoirs and channels formed in a material of the engine and positioned around the named components. The water jacket 800 includes a cylinder block 802 arranged below a cylinder head 804, with respect to the y-axis. The cylinder block 802 includes four cylinders 806 arranged in line along the z-axis. A first or main inlet 808 flowing coolant into the cylinder block 802 is coupled to the cylinder block 802 in front of one of the cylinders 806 at one end of the cylinder block 802 and a first or main outlet 810 flowing coolant out of the water jacket 800 is coupled to the cylinder head 804 above one of the cylinders 806 at an opposite end of the cylinder block 802.

The water jacket 800 includes various cooling channels such as a second inlet 812 flowing coolant from an EGR valve, a third inlet 814 flowing coolant from an EGR cooler, a second outlet 816 flowing coolant to the EGR cooler, a third outlet 818 flowing coolant to the EGR valve, a fourth outlet 820 flowing coolant to a turbocharger, and a fifth outlet 822 flowing coolant from a degas bottle. The engine further includes flow metering holes which, along with a geometry of the water jacket 800, may affect an optimized geometry of a diverter positioned in the water jacket 800.

Figure 9:
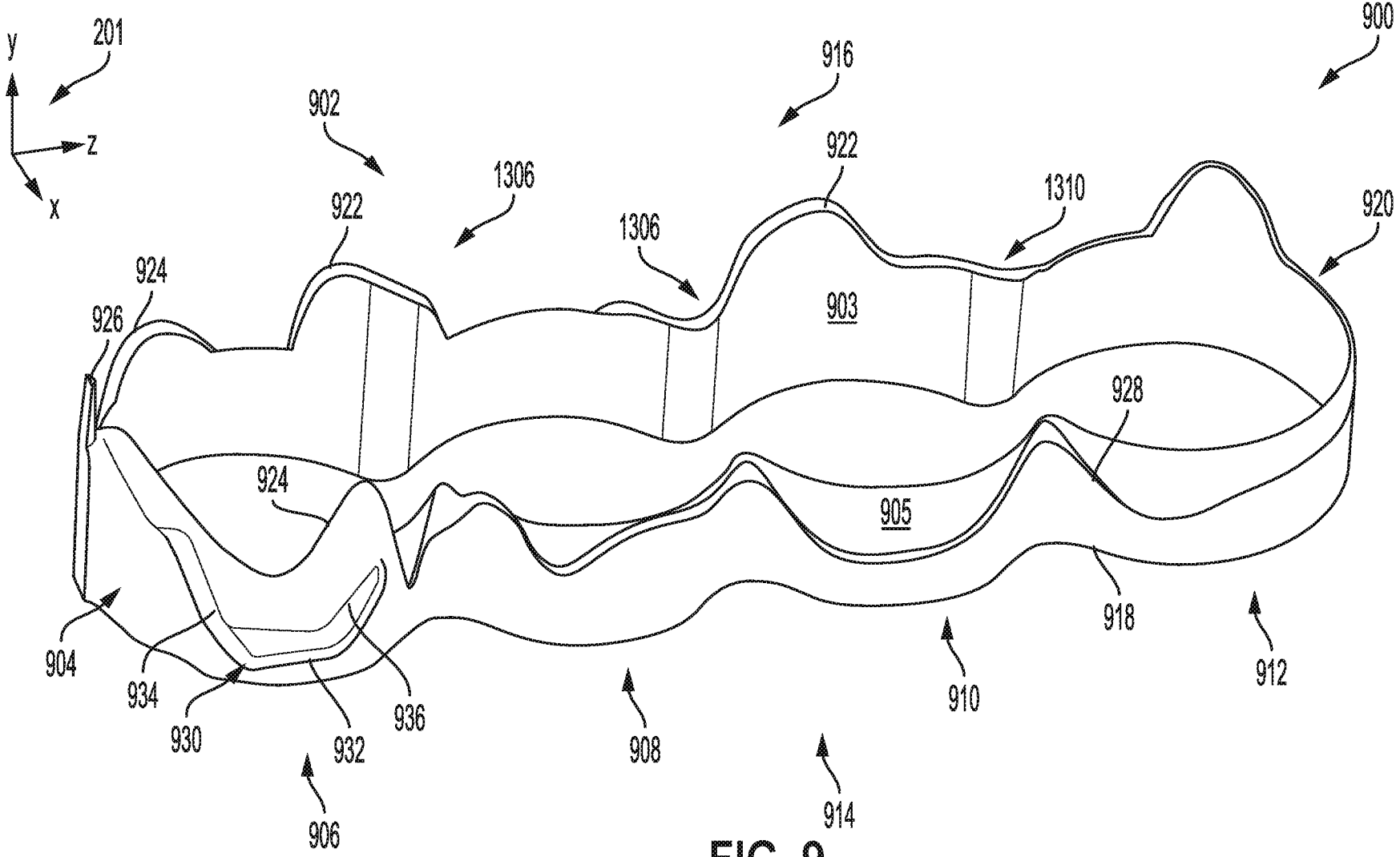
FIG. 9 shows a second example of a diverter with a curved top surface from a perspective view.
Figure 10:
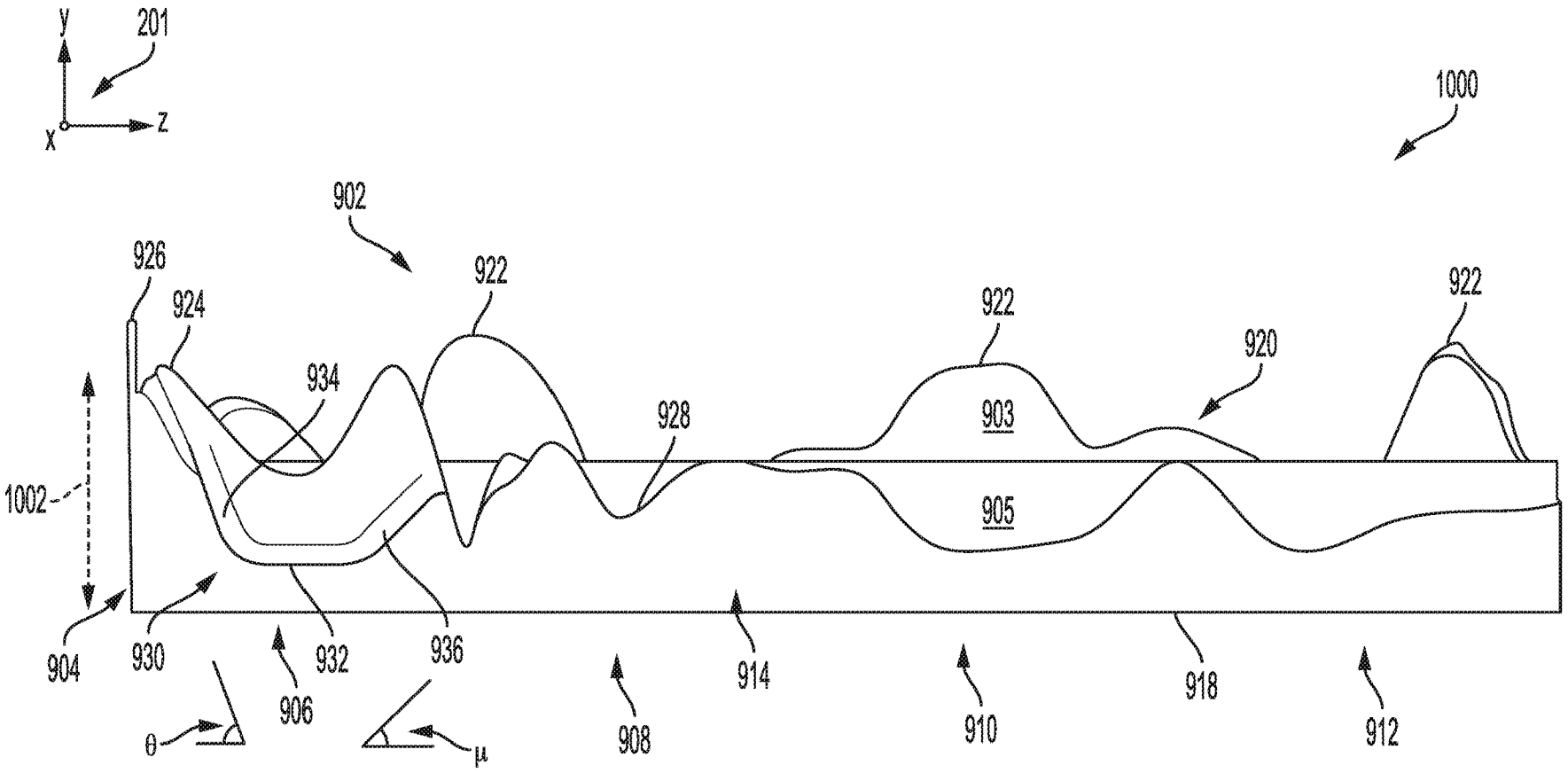
FIG. 10 shows a first side view of the diverter of FIG. 9.
Figure 11:
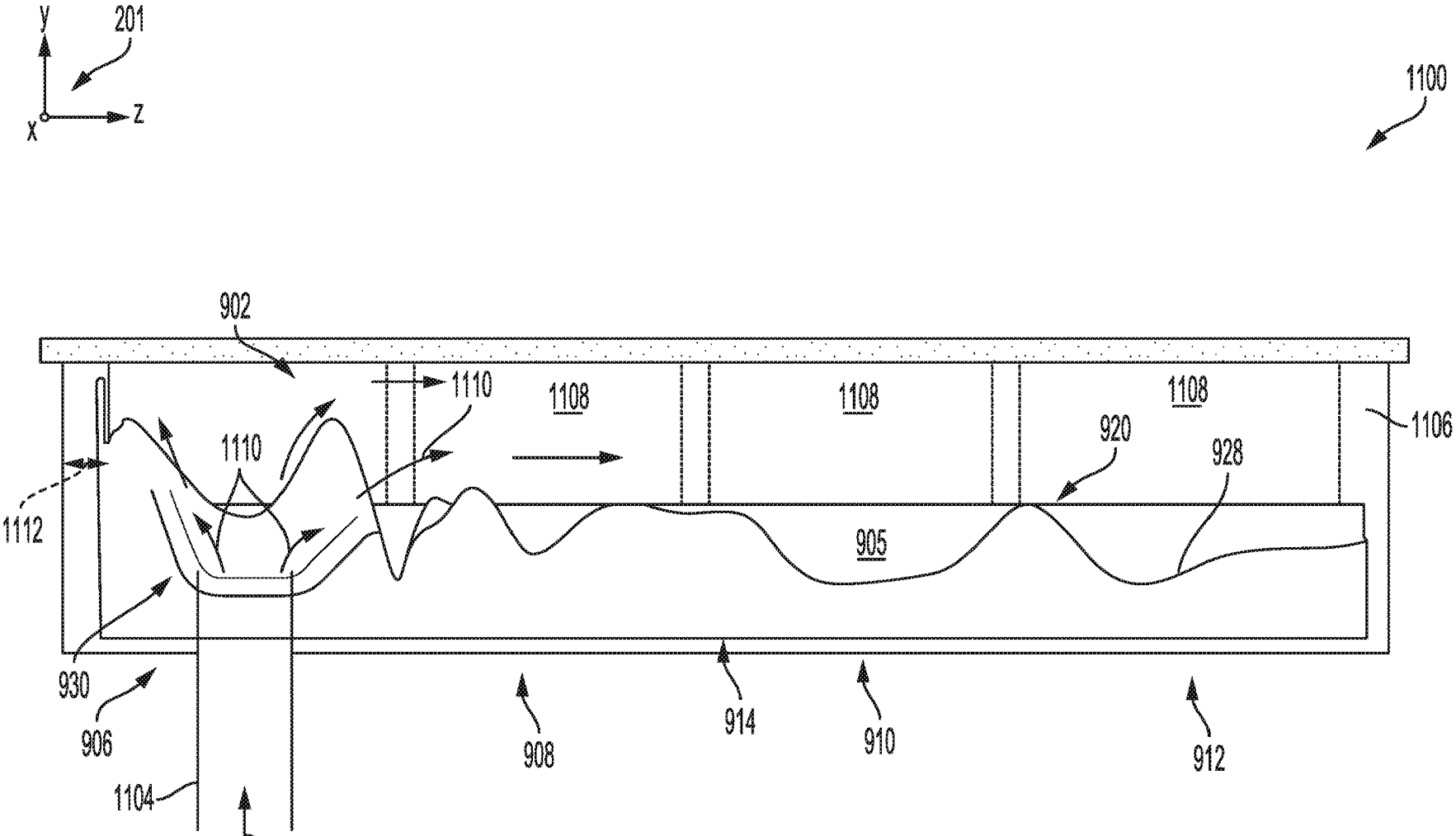
FIG. 11 shows the diverter of FIG. 9 inserted in a water jacket of a cylinder block.
Figure 12:
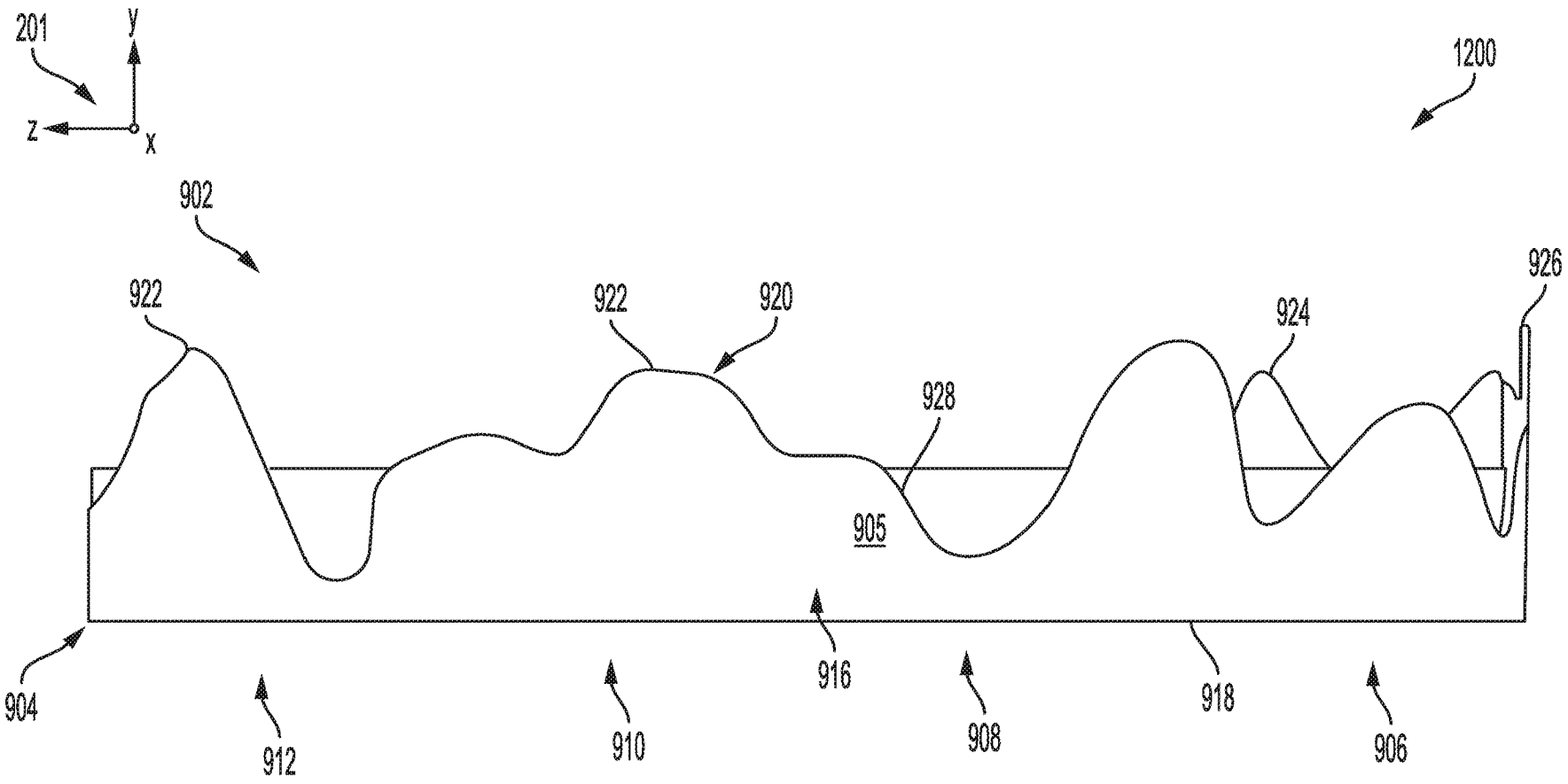
FIG. 12 shows a second side view of the diverter of FIG. 9.
Figure 13:
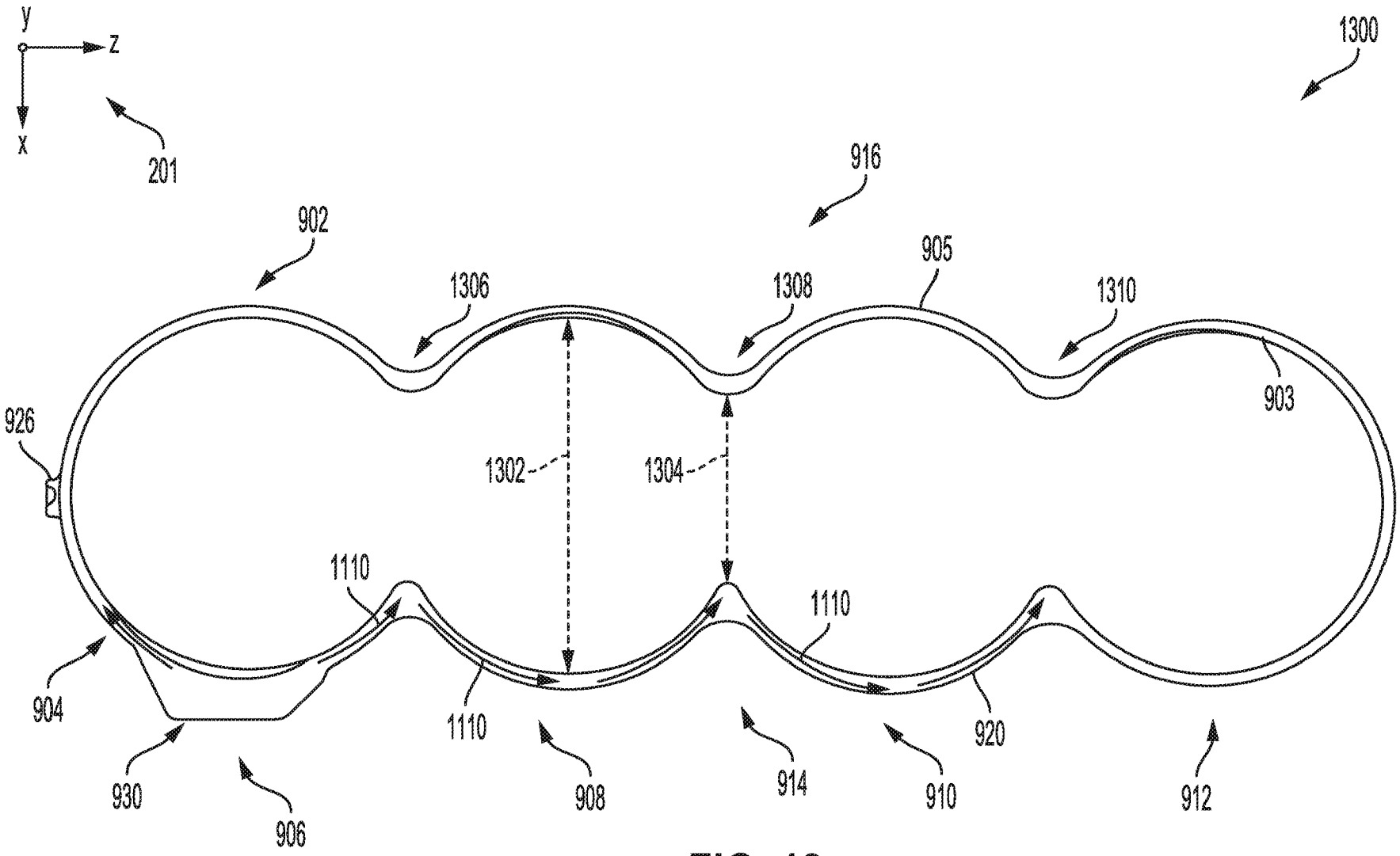
FIG. 13 shows a top-down view of the diverter of FIG. 9.

An example of a diverter 902 which may be arranged in the water jacket 800 of FIG. 8 is illustrated from a perspective view 900 in FIG. 9, from a front side view 1000 in FIG. 10, arranged in a cylinder block 1100 in FIG. 11, from a rear side view 1200 in FIG. 12, and from a top-down view 1300 in FIG. 13. Similar to the diverter 302 of FIGS. 3-7, the diverter 902 has a curved, continuous wall 904 without any sharp or angled regions, where the wall is shaped to surround four cylinders in a cylinder block. The wall 904 has a smooth inner face 903 and an outer face 905 with one or more regions where the outer face 905 protrudes outwards and away from the inner face 903, as described further below.

The diverter 902 includes a first circular section 906, a second circular section 908, a third circular section 910, and a fourth circular section 912, the circular sections aligned along the z-axis. A diameter 1302, as shown in FIG. 13, of each of the circular sections of the diverter 902 may be similar while a width 1304 of the diverter 902 in regions between the circular sections may be smaller than the diameter 1302 of the circular sections. In other words, the diverter 902 may have a first pinched region 1306 between the first circular section 906 and the second circular section 908, a second pinched region 1308 between the second circular section 908 and the third circular section 910, and a third pinched region 1310 between the third circular section 910 and the fourth circular section 912. The pinched regions may correspond to areas between cylinders of the cylinder block.

The first circular section 906 may be proximate to a main coolant inlet of the cylinder block, e.g., the main inlet 808 of FIG. 8, and the fourth circular section 912 may be proximate to a main coolant outlet of the cylinder block, e.g., the main outlet 810 of FIG. 8. The main coolant inlet and outlet may flow coolant into and out of the water jacket, respectively, at a first or front side 914 of the diverter 902. The diverter 902 also has a second or rear side 916, opposite of the front side 914 which may be proximate to other coolant channels as described above with reference to FIG. 8.

Similar to the diverter 302 of FIGS. 3-7, the diverter 902 has a bottom surface 918 that is parallel with the z-axis around an entire circumference of the diverter 902. A top surface 920 of the diverter, however, is not linear around the entire circumference. Instead, the top surface 920 may curve in sections around a perimeter of the diverter 902 in a variable manner with respect to the y-axis, forming a profile with unevenly spaced apart peaks, e.g., concave regions of increased height rising above linear portions of the top surface 920. A height 1002 of the diverter 902, as indicated in FIG. 10, may vary around the diverter 902 in a non-uniform manner and the peaks may be concentrated at the rear side 916 of the diverter 902, as shown in FIGS. 9-12. In addition, the wall 904 at the first circular section 906 may include more peaks than the second, third, and fourth circular sections 908, 910, 912. Furthermore, the peaks may not be symmetric about a highest point of each peak.

For example, as shown in FIGS. 9-10 and further illustrated in FIG. 11, the top surface 920 of the diverter 902 is mostly flat, e.g., linear and parallel with the x-z plane, across the front side 914 of the second circular section 908, and entirely flat across the front side 914 of each of the third circular section 910 and the fourth circular section 912. Along the rear side 916 of the diverter 902, the second circular section 908 includes a portion of a peak 922 while the third and fourth circular sections 910, 912 each include at least one peak 922.

The top surface 920 along the first circular section 906 shares one peak 922 with the second circular section 908 and further includes a plurality of peaks 924 distributed around a circumference of the first circular section 906. Each peak 922 and each of the plurality of peaks 924 may have varying heights, as defined along the y-axis, varying widths, as defined along the perimeter of the diverter 902, and varying shapes. The first circular section 906 also includes a tab 926 which may be greater in height than the peaks. The tab 926 may protrude outwards from the outer face 905 of the diverter 902 and extend upwards from the bottom surface 918 and maintain a position of the diverter 902 in a lower portion of the water jacket, similar to the tab 404 shown in FIGS. 3-4 and 6. As described above, the diverter 902 may include additional tabs positioned in areas corresponding to low pressure regions of the water jacket.

The diverter 902 has a sill 928 which is continuous around the entire perimeter of the diverter 902 and intermittently becomes portions of the top surface 920. More specifically, the sill 928 may be a continuous ledge along the outer face 905 of the diverter 902 which meanders along the y-axis, forming various peaks and valleys (e.g., regions of decreased height). The valleys may correspond to portions along the periphery of the diverter 902 where the sill 928 is of a lesser height than linear portions of the top surface 920 (e.g., where the top surface 920 is parallel with the x-y plane). A thickness, e.g., a distance between the inner face 903 and the outer face 905, of the diverter 902 may be greater between the sill 928 and the bottom surface 918 than between the sill 928 and the top surface 920 (in regions where the sill 928 is lower in height than the top surface 920 such as the valleys). At each peak 922 and each of the plurality of peaks 924, the sill 928 forms the top surface 920.

The outer face 905 of the diverter 902 further includes a bracket 930 at the front side 914 of the first circular section 906. The bracket 930 may be a protrusion positioned at a mid-point along the y-axis between the bottom surface 918 and the top surface 920 of the diverter 902. The bracket 930 may be continuous with the wall 904, e.g., seamlessly coupled and integral with the wall 904, and protrude outwards, away from the outer face 905 along the x-z plane. For example, the diverter 902 may be formed as a single continuous unit, including the bracket 930, by a method such as injection molding, additive manufacturing, etc. In other examples, however, the bracket 930 may be attached to the wall 904 of the diverter 902 by welding, adhesive, etc.

The bracket 930 has a middle (e.g., central) portion 932 that is parallel with the bottom surface 918 of the diverter 902, a first side portion 934 coupled to one end of the middle portion 932 and a second side portion 936 coupled to an opposite end of the middle portion 932 from the first side portion 934. The first side portion 934 and the second side portion 936 may slope upwards and away from the middle portion 932 along opposite directions. A first angle θ formed between the slope of the first side portion 934 and the bottom surface 918 may be similar to or different from a second angle μ formed between the slope of the second side portion 936 and the bottom surface 918, as indicated in FIG. 10. Each of the first angle θ and the second angle μ may be between 5 and 85 degrees. The angles may be customized according to a positioning of a main coolant inlet 1102, as shown in FIG. 11, relative to the diverter 902 and may thus vary with a specific geometry of the inlet. As described above with respect to the first and second ramps 326, 328 of the diverter 302 illustrated in FIGS. 3-7, how the inlet bends prior to coupling to the water jacket, where the inlet couples to the water jacket along the height of the diverter 902, etc., may affect the slope of each of the first and second side portions 934, 936.

The bracket 930 may be positioned directly in front of the main coolant inlet 1102, as shown in FIG. 11. The main coolant inlet 1102 may be coupled to a water jacket 1106 proximate to the front side 914 of the first circular section 906 of the diverter 902 when the diverter 902 is placed in the water jacket 1106 of the cylinder block 1100. In one example, the water jacket 1106 may be the water jacket 800 of FIG. 8 and may surround four cylinders 1108 of the cylinder block 1100. The coolant may flow into the water jacket 1106 as indicated by arrows 1110 shown in FIGS. 10 and 13.

The protrusion of the bracket 930 away from the outer face 905 of the diverter 902 may extend at least partially across a width 1112 of the water jacket 1106 and force the incoming coolant to flow upwards, as guided by the sloping first and second side portions 932, 934 of the bracket 930. A volume of the water jacket 1106 above the diverter 902 is greater than a portion of the water jacket in which the diverter 902 is seated, driving displacement of coolant to the portion of the water jacket above the diverter 902. The coolant flow field in the water jacket 1106 is thus modified to increase coolant volume and flow above the diverter 902.

The absence of peaks along the front side 914 of the diverter 902 across the second, third, and fourth circular sections 908, 910, 912 promotes rapid flow of coolant above the front side 914 of the diverter 902, from the first circular section 906 to the fourth circular section 912. Coolant may exit the water jacket at a main coolant outlet arranged above the front side 914 of the fourth circular section 912 of the diverter 902. Coolant velocity and replacement of coolant with fresh, colder coolant is thus increased through the upper portion of the water jacket 1106.

The presence of peaks 922 along the rear side 916 of the diverter as well as the plurality of peaks 924 arranged along the top surface 920 of the first circular section 906 may further assist in driving coolant flow upwards, enhancing a cooling of an upper region of the cylinder block. By implementing a diverter with a contoured top surface, such as the diverter 302 of FIGS. 3-7 and the diverter 902 of FIGS. 9-13, thermal distortion is reduced and as well as friction impeding coolant flow into the water jacket of the cylinder block. A pressure gradient across the water jacket is reduced while regions of stagnant coolant are minimized. As such, equalization of cylinder-cylinder balance is enabled and hydraulic penalties leading to parasitic losses at a coolant pump are decreased.

It will be appreciated that the diverters shown and described herein are non-limiting examples. Other examples of a diverter with a top profile including both curved and linear portions may include adaptation of the diverter to a different engine bank configuration, e.g., twin, V6, etc., variations in diverter thickness, width, height, top surface profile, rail and/or bracket and/or ramp geometry, etc. The diverter may be formed from a variety of materials including a metal, a polymer, a composite, etc. via a variety of methods such as molding techniques, additive manufacturing, etc.

In this way a diverter or spacer for a cylinder block water jacket may efficiently cool cylinder components without increasing a load at a water pump. Friction between surfaces of the diverter and coolant are reduced, thereby decreasing hydraulic losses and thermal distortion. A geometry, e.g., a top surface profile, of the diverter may be configured to increase coolant flow through an upper portion of the water jacket and reduce pressure differences in the water jacket between cylinders. The top surface of the diverter may be irregular, e.g., non-uniformly shaped, and include both curved and linear portions, with a profile forming peaks and valleys arranged around a perimeter of the diverter to optimize coolant flow. The diverter may further include one or more protrusions extending from an outer face of the diverter to encourage upwards flow of coolant as coolant enters the water jacket. Engine performance is increased as a result and a useful life of the cylinder components may be prolonged, thereby reducing costs.

The technical effect of implementing a diverter with a contoured, curving top surface is that a coolant flow field within a cylinder water jacket is modified to increase coolant flow above the diverter and cylinder to cylinder balance is equalized.

The disclosure also provides support for a diverter for a water jacket, comprising: a continuous upper rail arranged around a top periphery of the diverter, the upper rail having a profile including both linear portions and portions curving along a cylinder axis of the diverter, and at least one protrusion extending away from an outer face of the diverter, the at least one protrusion positioned proximate to a coolant inlet flowing coolant into the water jacket. In a first example of the system, the profile of the upper rail includes an uneven and non-uniform arrangement of peaks and wherein the peaks are concave regions of increased height extending above linear portions of the upper rail. In a second example of the system, optionally including the first example, a lower rail of the diverter, positioned opposite form the upper rail, is flat and linear around a bottom periphery of the diverter and wherein a distance between the upper rail and the lower rail varies around a perimeter of the diverter. In a third example of the system, optionally including the first and second examples, the diverter includes a plurality of circular sections, the plurality of circular sections continuous with one another and each having a similar diameter and wall thickness and wherein the plurality of circular sections forms a wall of the diverter. In a fourth example of the system, optionally including the first through third examples, the at least one protrusion extends from the outer face of the diverter at a first circular section of the plurality of circular sections, the first circular section proximate to the coolant inlet and wherein the at least one protrusion includes at least one region of increased wall thickness. In a fifth example of the system, optionally including the first through fourth examples, the at least one protrusion includes sloped portions configured to guide coolant flow upwards and above the upper rail of the diverter.

The disclosure also provides support for a diverter for a water jacket of a cylinder block, comprising: a continuous upper rail forming a top surface of the diverter, the top surface having portions curving along a cylinder axis of the cylinder block, and one or more protrusions extending from an outer face of the diverter, the one or more protrusions having at least one sloped surface, wherein the diverter is configured to be seated within a lower portion of the water jacket to divert coolant to an upper portion of the water jacket above the diverter. In a first example of the system, a wall of the diverter is formed of a plurality of circular sections continuous with one another and wherein a profile of the upper rail is different for each of the plurality of circular sections. In a second example of the system, optionally including the first example, a variation in a height of the wall of the diverter within a first circular section of the plurality of circular sections, the first circular section farthest from a coolant inlet, is greater than a variation in the height of the wall at remaining circular sections of the plurality of circular sections. In a third example of the system, optionally including the first and second examples, an average height of the wall of the diverter within the first circular section is lower along a first side of the diverter than along a rear side of the diverter and wherein the coolant inlet is coupled to the water jacket in front of the first side of the diverter. In a fourth example of the system, optionally including the first through third examples, the outer face at the first side of the diverter along a second circular section of the plurality of circular sections, the second circular section closest to the coolant inlet, has a first ramp sloping upwards from a lower rail of the diverter, the lower rail opposite of the upper rail, at a first angle relative to the bottom edge and a second ramp sloping upwards from the lower rail at a second angle relative to the bottom edge, the first and second ramps spaced apart from one another and sloping in opposite directions. In a fifth example of the system, optionally including the first through fourth examples, the first and second ramps each continue around the diverter in opposite directions and merge with the upper rail. In a sixth example of the system, optionally including the first through fifth examples, the second ramp includes a ledge extending a distance around the outer face of the diverter and wherein a thickness of the wall of the diverter is increased between the ledge and a lower rail of the diverter. In a seventh example of the system, optionally including the first through sixth examples, the wall of the diverter at a first side of the diverter, the first side proximate to a coolant inlet flowing coolant into the water jacket, is less variable in height than at a second side of the diverter, opposite of the first side. In an eighth example of the system, optionally including the first through seventh examples, a first circular section of the plurality of circular sections, the first circular section closest to the coolant inlet, includes more peaks than any remaining circular sections of the plurality of circular sections, and wherein the peaks are regions where the upper rail curves above linear portions of the upper rail. In a ninth example of the system, optionally including the first through eighth examples, the first circular section has a bracket protruding outwards from the outer face of the diverter, along the first side of the diverter and wherein the bracket protrudes from the outer face at a mid-point along a height of the wall of the diverter. In a tenth example of the system, optionally including the first through ninth examples, the bracket has a central portion that is parallel with a lower rail of the diverter and side portions that slope upwards and away from the central portion along opposite directions at opposite ends of the central portion. In an eleventh example of the system, optionally including the first through tenth examples, the diverter includes a sill protruding outwards from the outer face of the diverter and continuous around a perimeter of the diverter and wherein the sill becomes the upper rail of the diverter when the sill rises higher than the linear portions of the upper rail.

The disclosure also provides support for an engine block, comprising: a cylinder block with a plurality of cylinders, a water jacket disposed in the cylinder block, surrounding the plurality of cylinders and configured to flow coolant through the cylinder block, and a water jacket diverter seated within a lower portion of the water jacket, the diverter arranged around the plurality of cylinders and having a variable height arising from an upper rail of the diverter, the upper rail having both curved and linear portions. In a first example of the system, the upper rail of the diverter is configured to increase coolant flow from a first end of the water jacket, the first end proximate to a coolant inlet, to a second end of the water jacket, the second end distal to the coolant inlet, while reducing friction between surfaces of the diverter and the coolant.

In another representation, a spacer for a water jacket includes a wall formed of a plurality of circular sections, the plurality of circular sections configured to surround combustion chambers of an engine, and an upper rail continuous across the plurality of circular sections, the upper rail having sections forming peaks and valleys along a cylinder axis of the water jacket.

It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A diverter for a water jacket, comprising:

a continuous upper rail arranged around a top periphery of the diverter, above and perpendicular to an inner face and an opposing outer face of the diverter, the upper rail having a profile including both linear portions and portions curving along a cylinder axis of the diverter; and at least one protrusion extending away from the outer face of the diverter, the at least one protrusion positioned proximate to a coolant inlet flowing coolant into the water jacket, wherein the profile of the upper rail includes an uneven and non-uniform arrangement of peaks and wherein the peaks are concave regions of increased height extending above linear portions of the upper rail.

2. The diverter of claim 1, wherein a lower rail of the diverter, positioned opposite form the upper rail, is flat and linear around a bottom periphery of the diverter and wherein a distance between the upper rail and the lower rail varies around a perimeter of the diverter.

3. The diverter of claim 1, wherein the diverter includes a plurality of circular sections, the plurality of circular sections continuous with one another and each having a similar diameter and wall thickness and wherein the plurality of circular sections forms a wall of the diverter.

4. The diverter of claim 3, wherein the at least one protrusion extends from the outer face of the diverter at a first circular section of the plurality of circular sections, the first circular section proximate to the coolant inlet and wherein the at least one protrusion includes at least one region of increased wall thickness.

5. The diverter of claim 3, wherein the at least one protrusion includes sloped portions configured to guide coolant flow upwards and above the upper rail of the diverter.

6. A diverter for a water jacket of a cylinder block, comprising:

a continuous upper rail forming a top surface of the diverter, the top surface having portions curving along a cylinder axis of the cylinder block, and one or more protrusions extending from an outer face of the diverter, the one or more protrusions having at least one sloped surface, wherein the diverter is configured to be seated within a lower portion of the water jacket to divert coolant to an upper portion of the water jacket above the diverter, wherein a profile of the upper rail varies in shape and a height of the wall of the diverter for each of the plurality of circular sections.

7. The diverter of claim 6, wherein a wall of the diverter is formed of a plurality of circular sections continuous with one another.

8. The diverter of claim 7, wherein a variation in the height of the wall of the diverter within a first circular section of the plurality of circular sections, the first circular section farthest from a coolant inlet, is greater than a variation in the height of the wall at remaining circular sections of the plurality of circular sections.

9. The diverter of claim 8, wherein an average height of the wall of the diverter within the first circular section is lower along a first side of the diverter than along a rear side of the diverter and wherein the coolant inlet is coupled to the water jacket in front of the first side of the diverter.

10. The diverter of claim 9, wherein the outer face at the first side of the diverter along a second circular section of the plurality of circular sections, the second circular section closest to the coolant inlet, has a first ramp sloping upwards from a lower rail of the diverter, the lower rail opposite of the upper rail, at a first angle relative to the bottom edge and a second ramp sloping upwards from the lower rail at a second angle relative to the bottom edge, the first and second ramps spaced apart from one another and sloping in opposite directions.

11. The diverter of claim 10, wherein the first and second ramps each continue around the diverter in opposite directions and merge with the upper rail.

12. The diverter of claim 10, wherein the second ramp includes a ledge extending a distance around the outer face of the diverter and wherein a thickness of the wall of the diverter is increased between the ledge and a lower rail of the diverter.

13. The diverter of claim 7, wherein the wall of the diverter at a first side of the diverter, the first side proximate to a coolant inlet flowing coolant into the water jacket, is less variable in height than at a second side of the diverter, opposite of the first side.

14. The diverter of claim 13, wherein a first circular section of the plurality of circular sections, the first circular section closest to the coolant inlet, includes more peaks than any remaining circular sections of the plurality of circular sections, and wherein the peaks are regions where the upper rail curves above linear portions of the upper rail.

15. The diverter of claim 14, wherein the first circular section has a bracket protruding outwards from the outer face of the diverter, along the first side of the diverter and wherein the bracket protrudes from the outer face at a mid-point along a height of the wall of the diverter.

16. The diverter of claim 15, wherein the bracket has a central portion that is parallel with a lower rail of the diverter and side portions that slope upwards and away from the central portion along opposite directions at opposite ends of the central portion.

17. The diverter of claim 16, wherein the diverter includes a sill protruding outwards from the outer face of the diverter and continuous around a perimeter of the diverter and wherein the sill becomes the upper rail of the diverter when the sill rises higher than the linear portions of the upper rail.

18. An engine block, comprising:

a cylinder block with a plurality of cylinders;

a water jacket disposed in the cylinder block, surrounding the plurality of cylinders and configured to flow coolant through the cylinder block; and a water jacket diverter seated within a lower portion of the water jacket, the diverter arranged around the plurality of cylinders and having a variable height arising from an upper rail of the diverter, the upper rail having both curved and linear portions, wherein a profile of the upper rail varies in shape and a height of the wall of the diverter for each of the plurality of cylinders.

19. The engine block of claim 18, wherein the upper rail of the diverter is configured to increase coolant flow from a first end of the water jacket, the first end proximate to a coolant inlet, to a second end of the water jacket, the second end distal to the coolant inlet, while reducing friction between surfaces of the diverter and the coolant.

* * * * *